US010890863B2

(12) United States Patent
Nakamura et al.

(10) Patent No.: US 10,890,863 B2
(45) Date of Patent: Jan. 12, 2021

(54) DEVELOPING DEVICE AND REMANUFACTURING METHOD OF DEVELOPING DEVICE

(71) Applicant: CANON KABUSHIKI KAISHA, Tokyo (JP)

(72) Inventors: Yuuki Nakamura, Mishima (JP); Teruhiko Sasaki, Mishima (JP); Osamu Anan, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/780,724

(22) Filed: Feb. 3, 2020

(65) Prior Publication Data

US 2020/0272073 A1 Aug. 27, 2020

(30) Foreign Application Priority Data

Feb. 26, 2019 (JP) ..... 2019-033355

(51) Int. Cl.
*G03G 15/08* (2006.01)

(52) U.S. Cl.
CPC ..... *G03G 15/0894* (2013.01); *G03G 15/0812* (2013.01); *G03G 15/0881* (2013.01)

(58) Field of Classification Search
CPC ..... G03G 15/0894; G03G 15/0812; G03G 15/0881
See application file for complete search history.

(56) References Cited

U.S. PATENT DOCUMENTS

2006/0088334 A1* 4/2006 Martin ..... G03G 15/0894 399/109
2009/0110433 A1* 4/2009 Perez ..... G03G 15/0894 399/109
2019/0064697 A1* 2/2019 Harada ..... G03G 15/0225

FOREIGN PATENT DOCUMENTS

JP 2009-288286 A 12/2009
JP 2017-156474 A 9/2017

* cited by examiner

*Primary Examiner* — Susan S Lee
(74) *Attorney, Agent, or Firm* — Canon U.S.A., Inc., IP Division

(57) ABSTRACT

A remanufacturing method of a developing device is provided. The developing device includes a frame configured to store developer, a developer carrying member configured to carry the developer, a regulating member including a regulating portion configured to regulate the developer carried on the developer carrying member, and a storage member configured to store the developer, the storage member being mounted on the regulating member. A storage portion configured to store the developer and a first opening communicating with the storage portion are formed between the storage member and the regulating member, the first opening is opposed to an exposed portion of the developer carrying member, and the exposed portion is exposed to an outside of the frame. The remanufacturing method includes forming a communicating hole communicating with the storage portion, and removing the developer from the storage portion.

20 Claims, 14 Drawing Sheets

DEVELOPING DEVICE AND REMANUFACTURING METHOD OF DEVELOPING DEVICE

BACKGROUND OF THE INVENTION

Field of the Invention

The present disclosure relates to a developing device used for an electrophotographic image forming apparatus such as a copying machine and a printer, and a remanufacturing method of the developing device.

Description of the Related Art

An electrophotographic image forming apparatus (image forming apparatus) is an apparatus that forms an image on a recording medium by an electrophotographic image forming process. Examples of the image forming apparatus include an electrophotographic copying machine, an electrophotographic printer (light emitting diode (LED) printer, laser beam printer, etc.), a facsimile apparatus, and a word processor.

A developing device includes a developing unit that operates on an electrophotographic photosensitive member (photosensitive member). The developing device can be configured as a cartridge that can be mounted on and removed from an apparatus main body of the image forming apparatus.

The cartridge is configured to be mountable on and removable from the apparatus main body of the image forming apparatus. An example of the cartridge is a process cartridge. The process cartridge is a cartridge including the electrophotographic photosensitive member (photosensitive member) and a process unit that operates on the photosensitive member. Examples of the process unit include a developing unit, a charging unit, and a cleaning unit. Another example of the cartridge is a cartridge (developing cartridge) including a developing unit. In each cartridge system as described above, a maintenance work for the image forming apparatus can be carried out by replacing the cartridge.

A life of the developing device is consumed by developing an electrostatic latent image on the photosensitive member with developer. If the life of the developing device is consumed to such an extent that an image can no longer be formed with an image quality desired by a user, the developing device has come to an end of its life.

The developing device that has come to the end of its life can be remanufactured. Japanese Patent Application Laid-Open No. 2009-288286 discusses a method for refilling a cartridge with developer, replacing various components, and cleaning components to which developer has adhered.

On the other hand, Japanese Patent Application Laid-Open No. 2017-156474 discusses a method for fixing a member (collection member), which includes a storage portion for storing developer scattered from a regulating member (developing blade), to the developing blade to thereby prevent leakage of the developer.

In the case of remanufacturing the developing cartridge (developing device) including the collection member as discussed in Japanese Patent Application Laid-Open No. 2017-156474, it is desirable to remove the developer stored in the storage portion of the collection member.

SUMMARY OF THE INVENTION

The present disclosure is directed to providing a method for remanufacturing a developing device including a member that is mounted on a regulating member (developing blade) and includes a developer storage portion.

According to an aspect of the present disclosure, a remanufacturing method of a developing device is provided. The developing device includes a frame configured to store developer, a developer carrying member configured to carry the developer, the developer carrying member being rotatably supported by the frame, a regulating member including a regulating portion configured to regulate the developer carried on the developer carrying member, and a support portion configured to support the regulating portion, the support portion being fixed to the frame, and a storage member configured to store the developer, the storage member being mounted on the regulating member. A storage portion configured to store the developer and a first opening communicating with the storage portion are formed between the storage member and the regulating member, the first opening is opposed to an exposed portion of the developer carrying member, and the exposed portion is exposed to an outside of the frame. The remanufacturing method includes forming a communicating hole communicating with the storage portion, and removing the developer from the storage portion.

According to another aspect of the present disclosure, a developing device includes a frame configured to store developer, a developer carrying member configured to carry the developer, the developer carrying member being rotatably supported by the frame, a regulating member including a regulating portion configured to regulate the developer carried on the developer carrying member, and a support portion configured to support the regulating portion, the support portion including a first portion and a second portion, the regulating portion being mounted on the first portion, and a bent portion being formed between the first portion and the second portion, and a storage member configured to store the developer, the storage member being mounted on the regulating member, the storage member including a first cover portion and a second cover portion, the first cover portion overlapping each of the regulating portion and the first portion, and the second cover portion overlapping the second portion. A storage portion configured to store the developer, a first opening communicating with the storage portion, and a second opening communicating with the storage portion are formed between the storage member and the regulating member, the first opening is opposed to an exposed portion of the developer carrying member, and the exposed portion is exposed to an outside of the frame. The storage portion includes a first storage area formed between the regulating member and the first cover portion, and a second storage area formed between the regulating member and the second cover portion, the first opening communicates with the first storage area, and the second opening communicates with the second storage area. The storage member is provided with a communicating hole communicating with the storage portion.

Further features of the present disclosure will become apparent from the following description of exemplary embodiments with reference to the attached drawings.

DESCRIPTION OF THE EMBODIMENTS (Overall Structure of Image Forming Apparatus)

Figure 2:
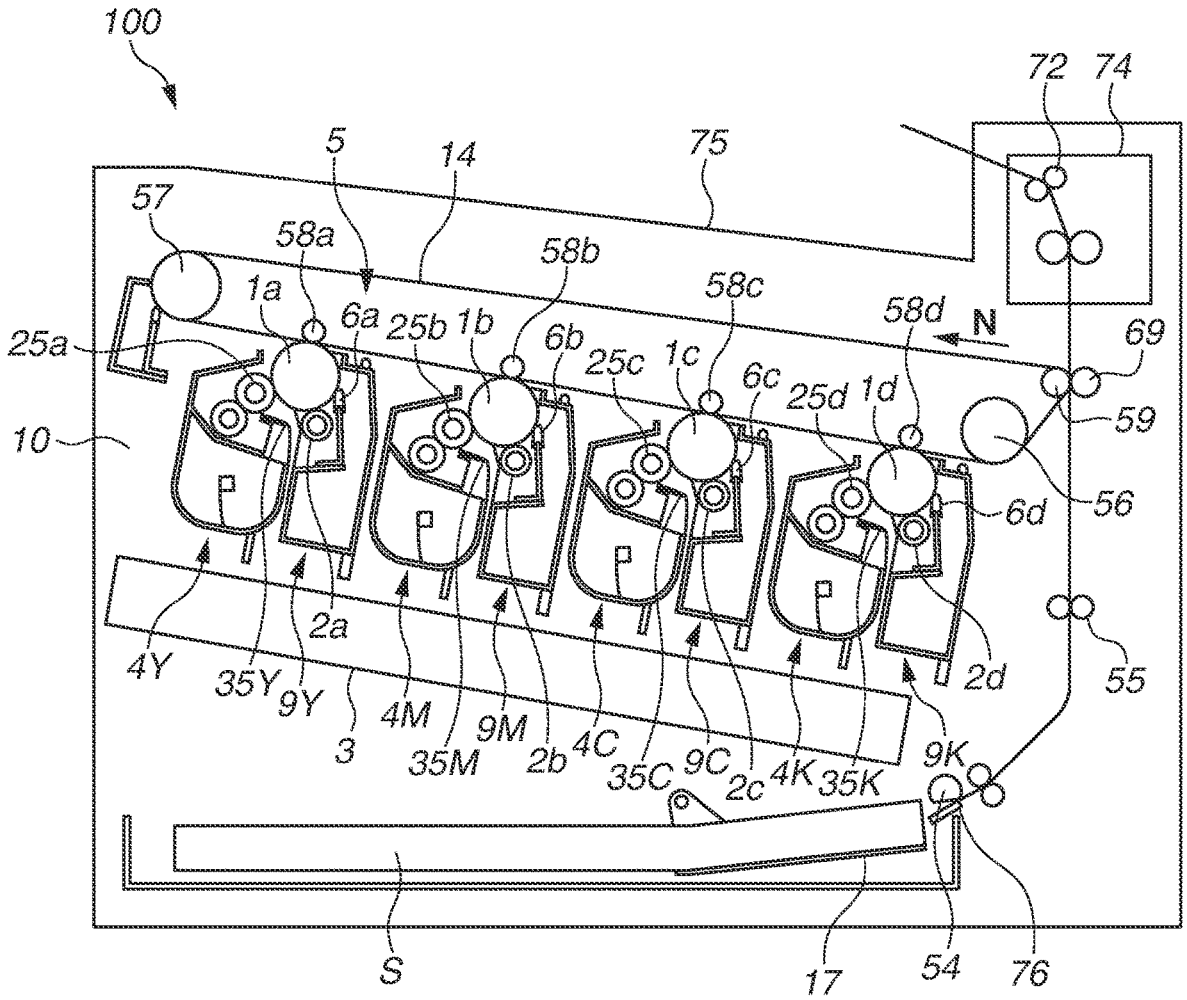
FIG. 2 is a sectional view illustrating an image forming apparatus according to the exemplary embodiment.

First, an overall structure of an electrophotographic image forming apparatus (hereinafter referred to as an image forming apparatus) 100 will be described with reference to FIG. 2. FIG. 2 is a sectional view schematically illustrating the image forming apparatus 100 according to an exemplary embodiment of the present disclosure.

As illustrated in FIG. 2, drum cartridges 9 each serving as a photosensitive member unit and developing cartridges 4 each serving as a developing device are mounted on an apparatus main body 10 of the image forming apparatus 100. In the present exemplary embodiment, four drum cartridges 9 (9Y, 9M, 9C, and 9K) and four developing cartridges 4 (4Y, 4M, 4C, and 4K) are mounted on the apparatus main body 10. The drum cartridges 9 and the developing cartridges 4 are each configured to be mountable on and removable from the apparatus main body 10.

As illustrated in FIG. 2, the drum cartridges 9 and the developing cartridges 4 are arranged to be inclined with respect to a horizontal direction in a state where the drum cartridges 9 and the developing cartridges 4 are mounted on the apparatus main body 10.

The drum cartridges 9 (9Y, 9M, 9C, and 9K) include electrophotographic photosensitive members (hereinafter referred to as photosensitive drums) 1 (1*a*, 1*b*, 1*c*, and 1*d*), respectively, each serving as an image carrying member that carries an electrostatic latent image. Process units, such as charging rollers 2 (2*a*, 2*b*, 2*c*, and 2*d*) each serving as a charging member and cleaning members 6 (6*a*, 6*b*, 6*c*, and 6*d*) each serving as a cleaning member, are provided near the corresponding photosensitive drum 1. The charging rollers 2 (2*a*, 2*b*, 2*c*, and 2*d*) charge surfaces of the photosensitive drums 1 (1*a*, 1*b*, 1*c*, and 1*d*), respectively. As described below, the electrostatic latent images formed on the photosensitive drums 1 (1*a*, 1*b*, 1*c*, and 1*d*) are developed with toner, which is used as developer, and toner images are formed on the photosensitive drums 1 (1*a*, 1*b*, 1*c*, and 1*d*). The cleaning members 6 (6*a*, 6*b*, 6*c*, and 6*d*) remove toner remaining on the photosensitive drums 1 (1*a*, 1*b*, 1*c*, and 1*d*), respectively, after the toner images formed on the photosensitive drums 1 (1*a*, 1*b*, 1*c*, and 1*d*) are transferred onto a recording medium S.

The developing cartridges 4 (4Y, 4M, 4C, and 4K) include development rollers 25 (25*a*, 25*b*, 25*c*, and 25*d*), respectively, as a developer carrying member that carries toner. The developing cartridges 4 (4Y, 4M, 4C, and 4K) include developing blades 35 (35Y, 35M, 35C, and 35K), respectively, each serving as a regulating member. The electrostatic latent images formed on the photosensitive drums 1 (1*a*, 1*b*, 1*c*, and 1*d*) are developed by the development rollers 25 (25*a*, 25*b*, 25*c*, and 25*d*), respectively. As a result, the toner image of each color is formed on each of the photosensitive drums 1 (1*a*, 1*b*, 1*c*, and 1*d*).

In the present exemplary embodiment, the drum cartridges 9 (9Y, 9M, 9C, and 9K) are configured to be mountable on and removable from the apparatus main body 10 along an axial direction of the respective photosensitive drums 1 (1*a*, 1*b*, 1*c*, and 1*d*). The developing cartridges 4 (4Y, 4M, 4C, and 4K) are configured to be mountable on and removable from the apparatus main body 10 along an axial direction of the respective development rollers 25 (25*a*, 25*b*, 25*c*, and 25*d*). An upstream side and a downstream side in a mounting direction in which the drum cartridges 9 and the developing cartridges 4 are mounted on the apparatus main body 10 are defined as a front-side-surface side and a back-side-surface side, respectively.

The apparatus main body 10 includes a scanner unit 3 as an exposure device. The scanner unit 3 is disposed below the drum cartridges 9 and the developing cartridges 4. The photosensitive drums 1 (1*a*, 1*b*, 1*c*, and 1*d*) charged by the charging rollers 2 (2*a*, 2*b*, 2*c*, and 2*d*), respectively, are exposed to light by the scanner unit 3. As a result, the electrostatic latent image corresponding to image information is formed on each of the photosensitive drums 1 (1*a*, 1*b*, 1*c*, and 1*d*).

A cassette 17 that stores the recording medium S such as paper is mounted on the apparatus main body 10. The cassette 17 is disposed below the scanner unit 3.

The apparatus main body 10 also includes a feed roller 54, a conveyance roller pair 76, and a registration roller pair 55. The feed roller 54 separates the recording medium S stored in the cassette 17 sheet by sheet and feeds the recording medium S. The conveyance roller pair 76 conveys the fed recording medium S. The registration roller pair 55 synchronizes the electrostatic latent image formed on each of the photosensitive drums 1 with the recording medium S.

An intermediate transfer unit 5 is mounted on the apparatus main body 10. The intermediate transfer unit 5 is disposed above the drum cartridges 9 and the developing cartridges 4. The toner images formed on the photosensitive drums 1 (1*a*, 1*b*, 1*c*, and 1*d*) are transferred onto the intermediate transfer unit 5. The intermediate transfer unit 5 includes a driving roller 56, a driven roller 57, primary transfer rollers 58 (58*a*, 58*b*, 58*c*, and 58*d*), and an opposed roller 59. The intermediate transfer unit 5 also includes a transfer belt 14.

The primary transfer rollers 58 (58*a*, 58*b*, 58*c*, and 58*d*) are disposed at respective positions corresponding to the photosensitive drums 1 (1*a*, 1*b*, 1*c*, and 1*d*). The opposed roller 59 is disposed at a position opposed to a secondary transfer roller 69 to be described below. During an image forming operation, the transfer belt 14 moves in a circulating manner in a direction indicated by an arrow N in FIG. 2 in a state where the transfer belt 14 is opposed to and in contact with the photosensitive drums 1 (1*a*, 1*b*, 1*c*, and 1*d*).

By applying a voltage to the primary transfer rollers 58 (58*a*, 58*b*, 58*c*, and 58*d*), the toner images are transferred onto the transfer belt 14 from the photosensitive drums 1 (1*a*, 1*b*, 1*c*, and 1*d*). By applying a voltage to both of the opposed roller 59 and the secondary transfer roller 69, the toner images are transferred onto the recording medium S from the transfer belt 14.

The apparatus main body 10 also includes a fixing portion 74. The recording medium S on which the toner images are formed is conveyed upward and is then heated and pressed by the fixing portion 74. Then, the toner images are fixed onto the recording medium S. Subsequently, the recording medium S is discharged onto a discharge portion 75 by a discharge roller 72.

(Mounting of Drum Cartridge and Developing Cartridge)

Figure 3:
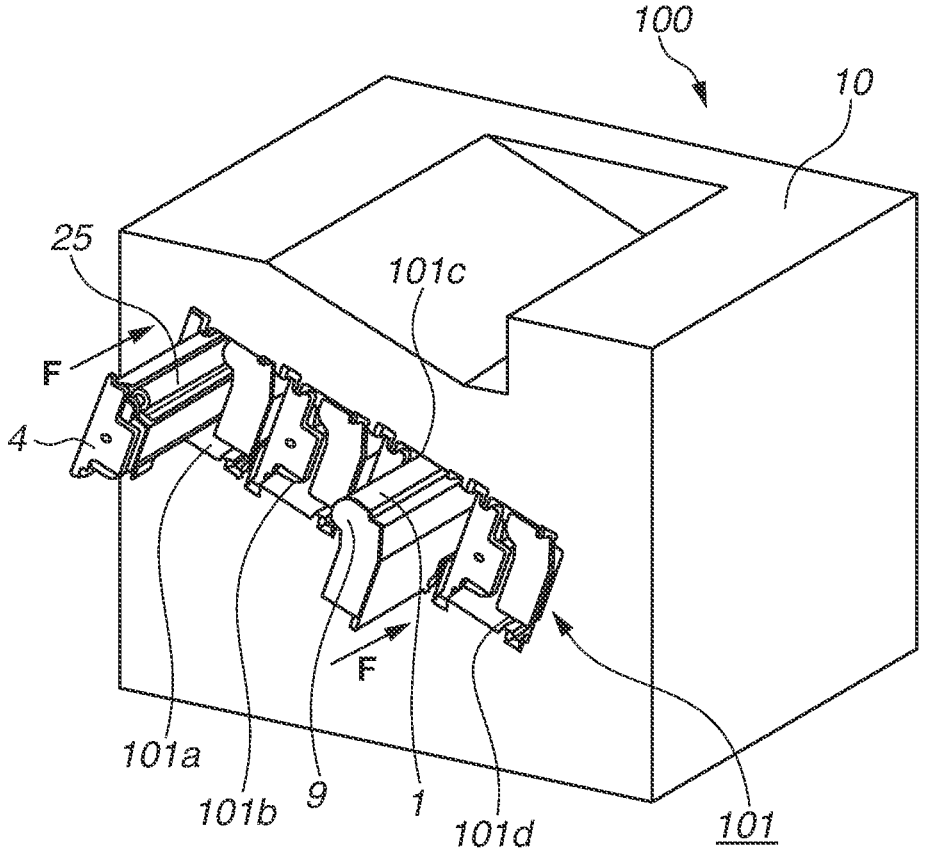
FIG. 3 is a view illustrating a drum cartridge and the developing cartridge to be mounted according to the exemplary embodiment.

Next, a configuration in which the drum cartridge 9 and the developing cartridge 4 are inserted into the apparatus main body 10 of the image forming apparatus 100 will be described with reference to FIG. 3. FIG. 3 is a view illustrating the drum cartridge 9 and the developing cartridge 4 to be mounted.

The drum cartridges 9 (9Y, 9M, 9C, and 9K) and the developing cartridges 4 (4Y, 4M, 4C, and 4K) are respectively inserted into opening portions 101 (101*a*, 101*b*, 101*c*, and 101*d*) of the apparatus main body 10. The drum cartridges 9 (9Y, 9M, 9C, and 9K) and the developing cartridges 4 (4Y, 4M, 4C, and 4K) are inserted from a front side to a back side in a direction indicated by an arrow F in FIG. 3. The drum cartridges 9 are inserted in a direction parallel to a rotational axis direction of the photosensitive drums 1 (1*a*, 1*b*, 1*c*, and 1*d*) to be described below. The developing cartridges 4 are inserted in a direction parallel to a rotational axis direction of the development rollers 25 to be described below.

In the present exemplary embodiment, the developing cartridges 4 and the drum cartridges 9 can be independently mounted on or removed from the apparatus main body 10. In a state where the developing cartridges 4 and the drum cartridges 9 are mounted on the apparatus main body 10, the rotational axis direction of each of the development rollers 25 is parallel to the rotational axis direction of each of the photosensitive drums 1.

(Drum Cartridge)

Figure 4:
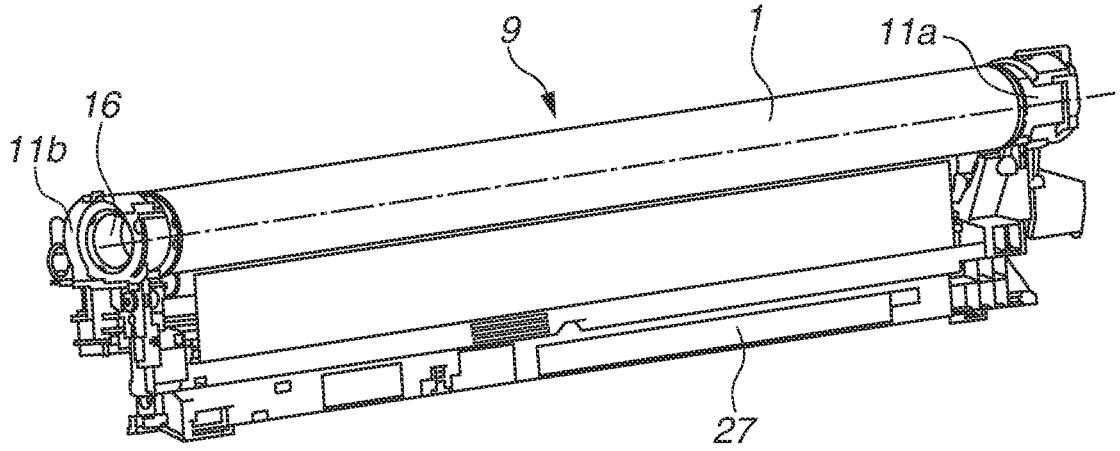
FIG. 4 is a perspective view illustrating the drum cartridge according to the exemplary embodiment.
Figure 5:
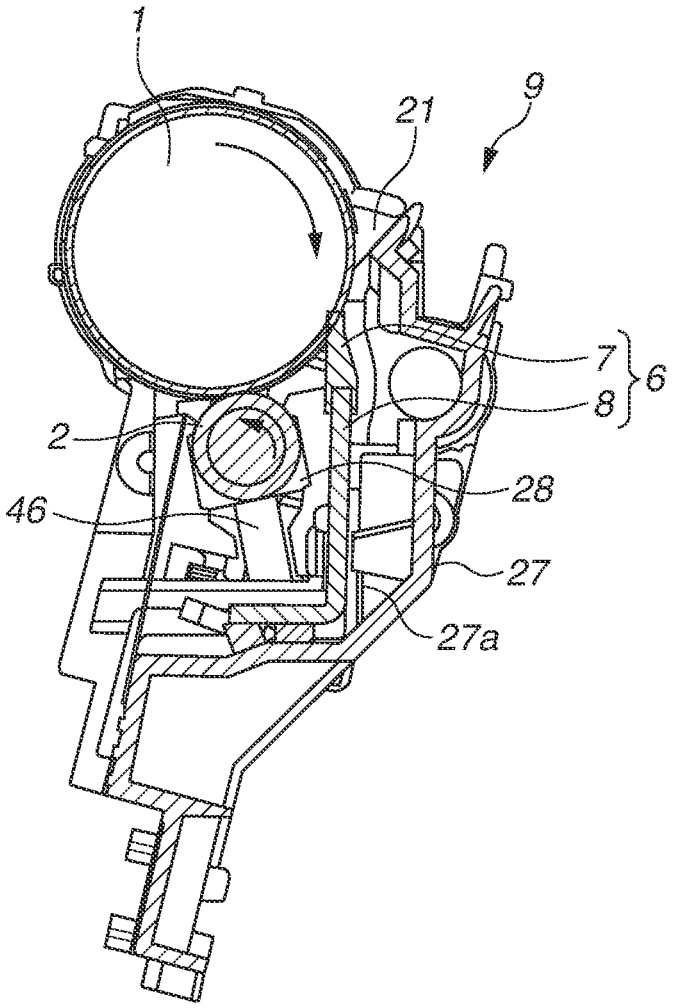
FIG. 5 is a sectional view illustrating the drum cartridge according to the exemplary embodiment.

The drum cartridges 9 (9Y, 9M, 9C, and 9K) will be described with reference to FIGS. 4 and 5. FIG. 4 is a perspective view schematically illustrating the drum cartridge 9. FIG. 5 is a sectional view illustrating the drum cartridge 9. More specifically, FIG. 5 is a sectional view of the drum cartridge 9 as viewed in a direction orthogonal to the rotational axis direction of the photosensitive drum 1. In other words. FIG. 5 is a sectional view of the drum cartridge 9 taken along the direction orthogonal to the rotational axis direction of the photosensitive drum 1 as viewed in the rotational axis direction of the photosensitive drum 1. In the present exemplary embodiment, the drum cartridges 9Y, 9M, 9C, and 9K have the same structure. Accordingly, the structure of only one of the drum cartridges 9 will be described below.

As illustrated in FIG. 4, the drum cartridge 9 includes a drum frame 27. The photosensitive drum 1 is rotatably supported by the drum frame 27 through a first drum bearing 11*a* and a second drum bearing 11*b*. The photosensitive drum 1 is rotatable about a rotational axis indicated by a dashed line. A drum coupling 16 that receives a driving force from the apparatus main body 10 is provided at one end in the rotational axis direction (longitudinal direction) of the photosensitive drum 1.

As illustrated in FIG. 5, a charging roller 2 and a cleaning member 6 are disposed near the photosensitive drum 1. The cleaning member 6 includes an elastic member 7, which is formed of a rubber blade, and a cleaning support member 8. In the image forming operation, the photosensitive drum 1 rotates in a direction indicated by an arrow in FIG. 5. The elastic member 7 contacts the photosensitive drum 1 in a counter direction to a rotating direction of the photosensitive drum 1. Residual toner removed from the photosensitive drum 1 by the cleaning member 6 falls in a residual toner chamber 27*a* of the drum frame 27.

As illustrated in FIG. 5, a sealing sheet 21 is attached to the drum frame 27 and contacts the photosensitive drum 1. The sealing sheet 21 prevents the residual toner in the residual toner chamber 27*a* from leaking from a gap between the drum frame 27 and the photosensitive drum 1.

When a driving force from a main body drive motor (not illustrated), which is a drive source, is transmitted to the drum coupling 16 of the drum cartridge 9, the photosensitive drum 1 rotates in response to the image forming operation. As illustrated in FIG. 5, the charging roller 2 is rotatably supported by the drum frame 27 through a charging roller bearing 28. The charging roller 2 is pressed against the photosensitive drum 1 by a pressing member 46 and is rotated by the photosensitive drum 1 (in the direction indicated by the arrow in FIG. 5).

(Developing Cartridge)

Figure 6:
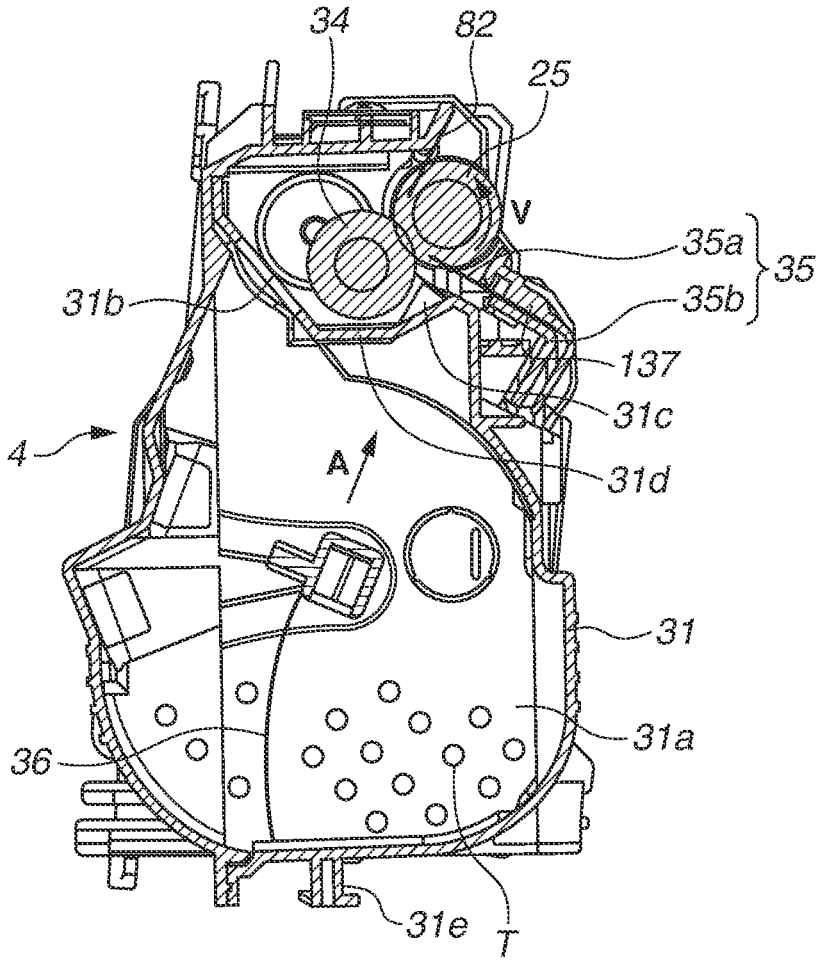
FIG. 6 is a sectional view illustrating the developing cartridge according to the exemplary embodiment.
Figure 7:
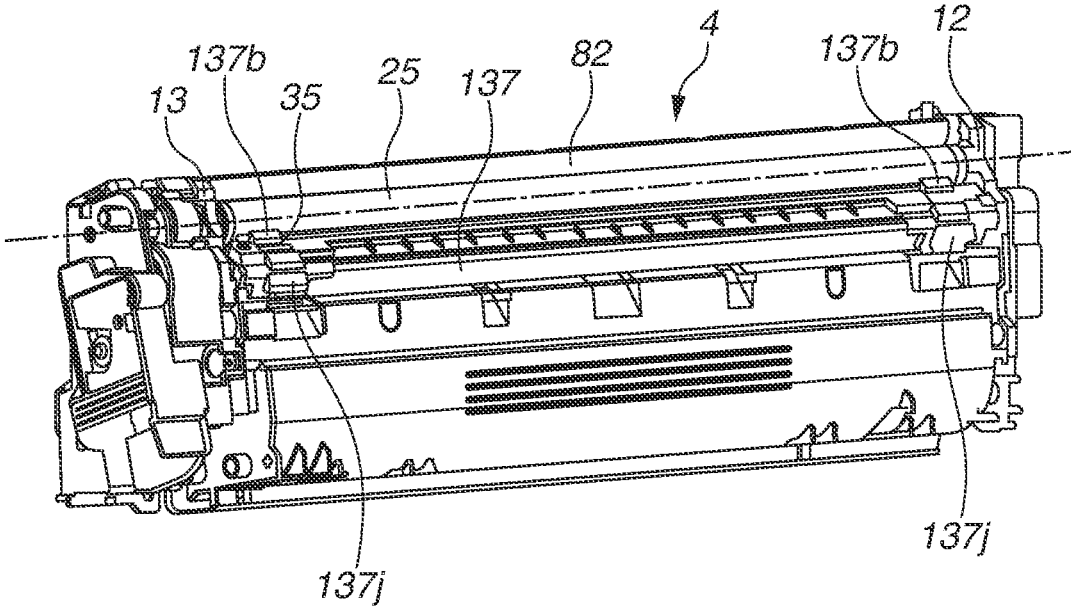
FIG. 7 is a perspective view illustrating the developing cartridge according to the exemplary embodiment.

Next, the developing cartridges 4 (4Y, 4M, 4C, and 4K) will be described with reference to FIGS. 6 and 7. FIG. 6 is a sectional view illustrating one of the developing cartridges 4. More specifically, FIG. 6 is a sectional view of the developing cartridge 4 as viewed in a direction orthogonal to the rotational axis direction of the development roller 25. In other words, FIG. 6 is a sectional view of the developing cartridge 4 cut through in the direction orthogonal to the rotational axis direction of the development roller 25 and viewed along the rotational axis direction of the development roller 25. FIG. 7 is a perspective view schematically illustrating the developing cartridge 4.

The developing cartridge 4Y that stores yellow toner, the developing cartridge 4M that stores magenta toner, the developing cartridge 4C that stores cyan toner, and the developing cartridge 4K that stores black toner have the same structure. Accordingly, the structure of only one of the developing cartridges 4 will be described below. The toner of each color is hereinafter simply referred to as toner T, without distinguishing the color of the toner.

The developing cartridge 4 includes a developing frame 31 that serves as a frame, the development roller 25, a toner supply roller 34 that rotates in contact with the development roller 25, the developing blade 35 that regulates a toner layer on the development roller 25, and a toner conveyance member 36. The toner T is stored in the developing frame 31. The development roller 25, the toner supply roller 34, the developing blade 35, and the toner conveyance member 36 are rotatably supported by the developing frame 31. The developing blade 35 is fixed to the developing frame 31. In the image forming operation, the development roller 25 rotates in a direction indicated by an arrow V in FIG. 6. The toner supply roller 34 rotates in contact with the development roller 25.

The developing frame 31 includes a development chamber 31*c* and a toner storage chamber 31*a* located below the development chamber 31*c*. The development roller 25 and the toner supply roller 34 are disposed in the development chamber 31*c*. The development chamber 31*c* and the toner storage chamber 31*a* are partitioned by a partition wall 31*d*. The partition wall 31*d* is provided with a toner opening 31*b* through which toner conveyed from the toner storage chamber 31*a* to the development chamber 31*c* passes.

The developing frame 31 is provided with a sealing sheet 82 that prevents the toner T from leaking from a gap between the developing frame 31 and the development roller 25. The development roller 25 is exposed to the outside of the developing frame 31 at a position that is on a downstream side of the developing blade 35 and on an upstream side of the sealing sheet 82 in the rotating direction of the development roller 25. The development roller 25 contacts the photosensitive drum 1 in a portion exposed from the developing frame 31. It can also be said that the portion that is located on the downstream side of the developing blade 35 and on the upstream side of the sealing sheet 82 in the rotating direction of the development roller 25 is an exposed portion of the development roller 25.

The developing frame 31 also includes a biasing portion 31*e*. The biasing portion 31*e* is biased by a biasing member (not illustrated) provided in the apparatus main body 10. With this structure, the developing frame 31 can move between a position thereof at which the development roller 25 contacts the photosensitive drum 1 and a position thereof at which the development roller 25 is apart from the photosensitive drum 1.

As illustrated in FIG. 7, the developing frame 31 includes a first development bearing 12 and a second development bearing 13. The development roller 25 and the toner supply roller 34 are rotatably supported by the first development bearing 12 and the second development bearing 13. In other words, the first development bearing 12 and the second development bearing 13 are parts of the developing frame 31. A dashed line illustrated in FIG. 7 indicates a rotational axis of the development roller 25. The first development bearing 12 and the second development bearing 13 are each disposed at each end of the developing frame 31 in the rotational axis direction of the development roller 25. In a state where the development roller 25 is in contact with the photosensitive drum 1, the development roller 25 rotates in the direction indicated by the arrow V (in FIG. 6) and the electrostatic latent image formed on the surface of the photosensitive drum 1 is developed with toner.

As illustrated in FIG. 6, the developing blade 35 includes a regulating portion 35*a* and a support portion 35*b* that supports the regulating portion 35*a*. The regulating portion 35*a* contacts the development roller 25 and regulates the toner T carried on the development roller 25. As a result, a toner layer having a uniform thickness is formed on a surface of the development roller 25. The support portion 35*b* is fixed to the developing frame 31. In the present exemplary embodiment, a part of the regulating portion 35*a* of the developing blade 35 is disposed vertically below the development roller 25.

The toner storage chamber 31*a* of the developing frame 31 is provided with the toner conveyance member 36 that stirs the stored toner and conveys the toner to the development chamber 31*c* through the toner opening 31*b*.

(Toner Collection Member)

Next, a collection member provided in the developing cartridge 4 will be described with reference to FIGS. 8A and 8B, 9, 10A and 10B, 11, and 12.

Figure 8A:
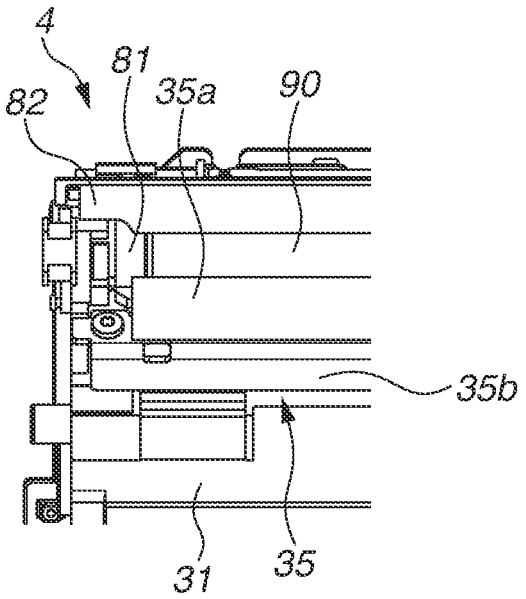
FIGS. 8A and 8B are partially enlarged views each illustrating the developing cartridge according to the exemplary embodiment.
Figure 8B:
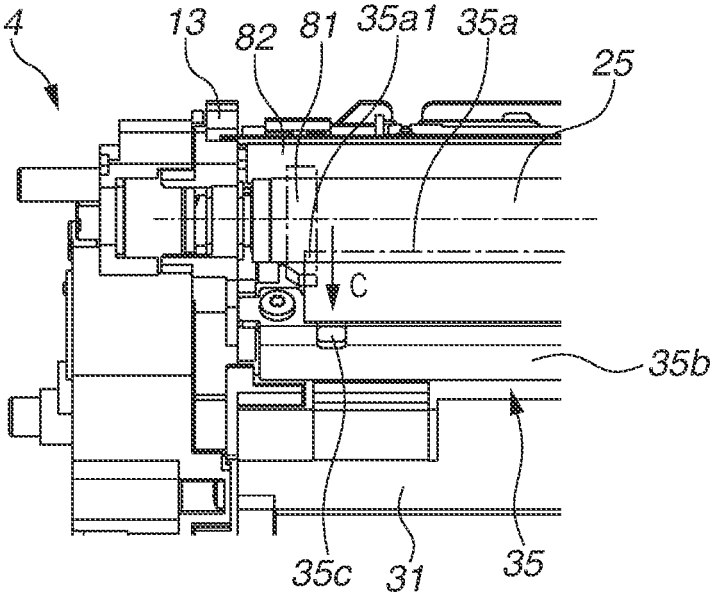
Figure 9:
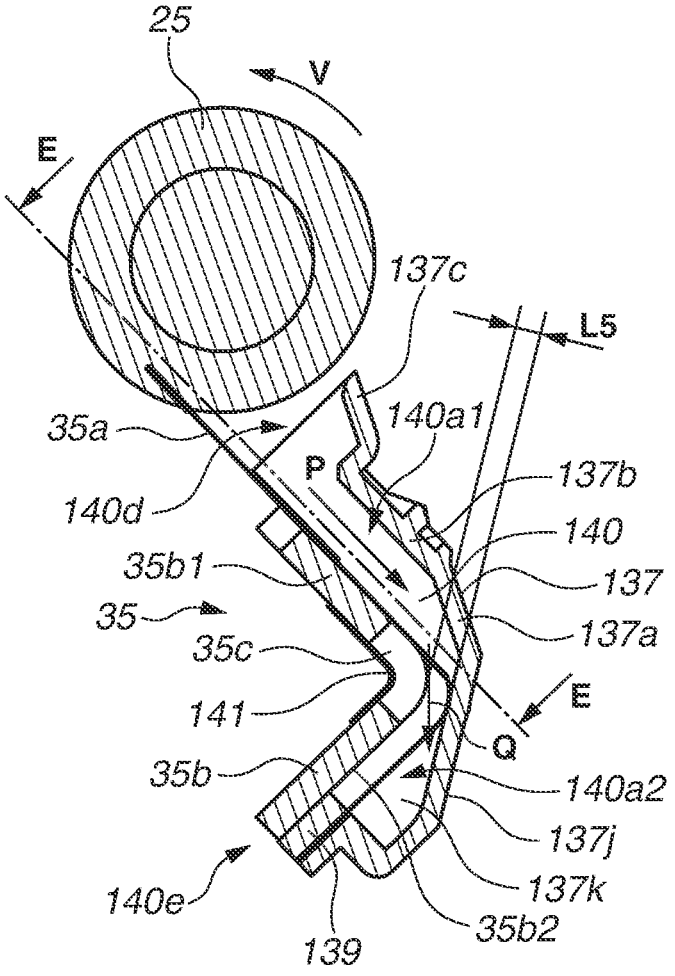
FIG. 9 is a sectional view illustrating the developing cartridge in the vicinity of the collection member according to the exemplary embodiment.
Figure 10A:
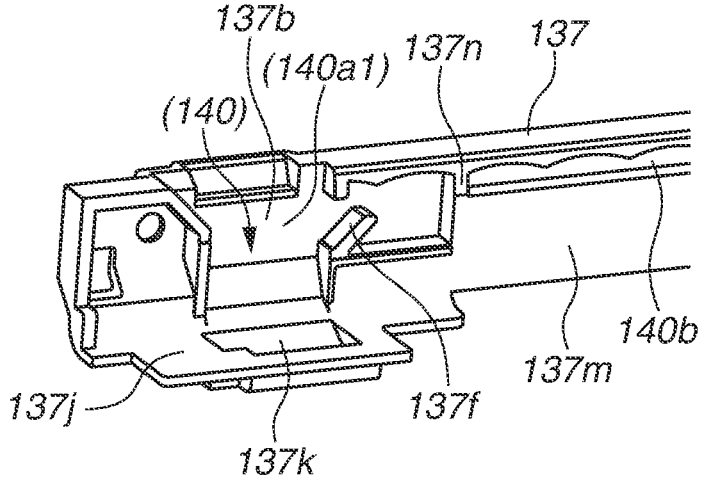
FIGS. 10A and 10B are perspective views each illustrating a configuration of the collection member according to the exemplary embodiment.
Figure 10B:
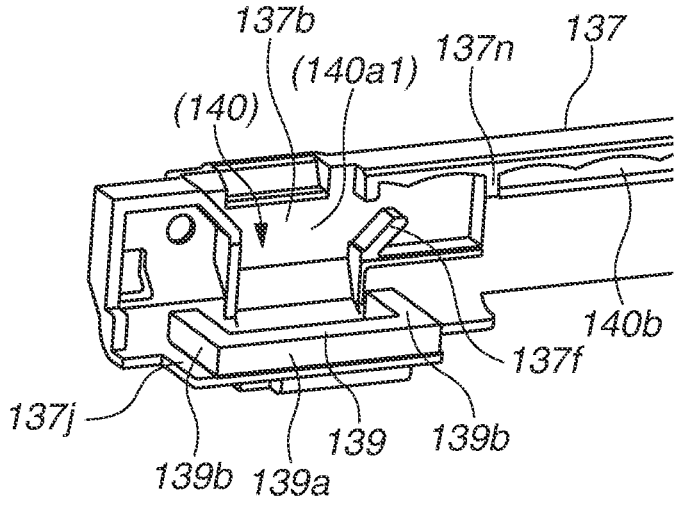
Figure 11:
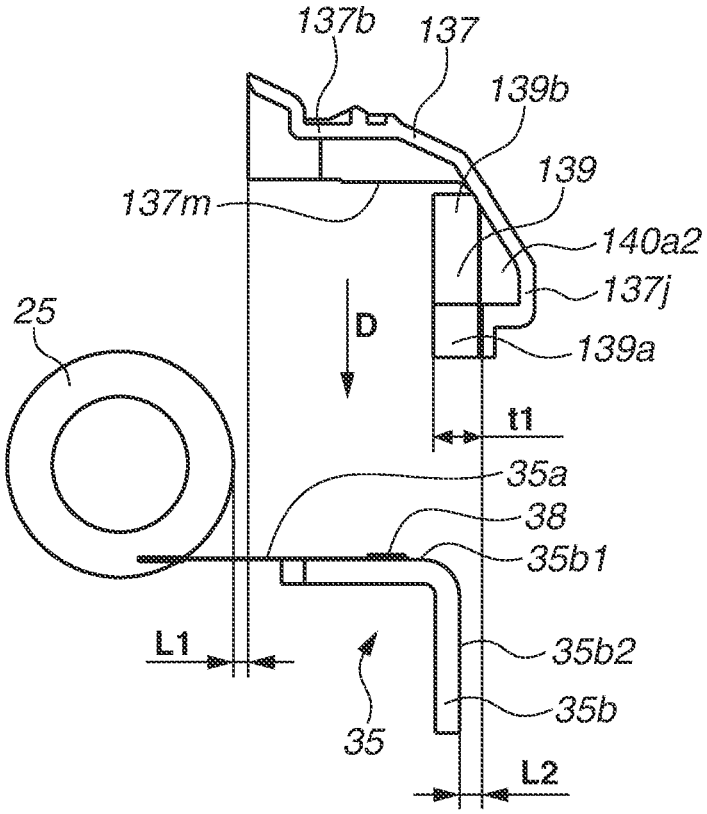
FIG. 11 is a sectional view illustrating the collection member to be mounted on a developing blade according to the exemplary embodiment.
Figure 12:
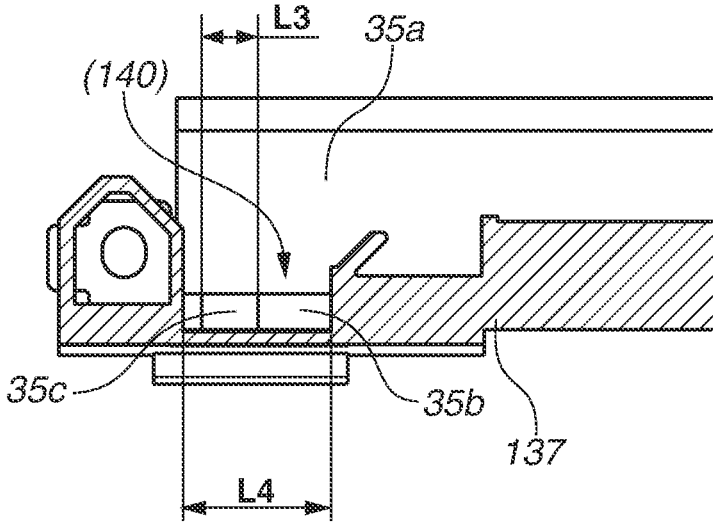
FIG. 12 is a view illustrating a positional relationship between the developing blade and the collection member according to the exemplary embodiment.

FIGS. 8A and 8B are partially enlarged views each illustrating the developing cartridge 4. FIG. 8A illustrates the developing cartridge 4 in a state before the development roller 25 is mounted thereon. FIG. 8B illustrates the developing cartridge 4 in a state after the development roller 25 is mounted thereon. FIG. 9 is a sectional view illustrating the developing cartridge 4 in the vicinity of a collection member 137. FIGS. 10A and 10B are perspective views each illustrating a configuration of the collection member 137. FIG. 10A illustrates the collection member 137 as viewed from a side of the developing blade 35. FIG. 10B is a view illustrating an elastic seal member 139 to be attached. FIG. 11 is a sectional view illustrating the collection member 137 to be mounted on the developing blade 35. FIG. 12 illustrates a positional relationship between the developing blade 35 and the collection member 137. FIG. 9 is illustrated based on an orientation in which the developing cartridge 4 is mounted on the apparatus main body 10. A vertical direction in FIG. 9 is the same as the perpendicular direction (gravitational direction). FIGS. 9 and 11 are sectional views in the direction orthogonal to the rotational axis direction of the development roller 25, similar to FIG. 6. FIG. 12 is a sectional view taken along a line E-E in FIG. 9.

As illustrated in FIGS. 8A and 8B, the developing cartridge 4 includes an end seal member 81. In the longitudinal direction of the developing cartridge 4, the end seal member 81 is mounted at an end of the developing frame 31. In the present exemplary embodiment, the end seal member 81 contacts the development roller 25 to prevent the toner T from leaking from the gap between the development roller 25 and the developing frame 31. In the present exemplary embodiment, the longitudinal direction of the developing cartridge 4 is the same as the rotational axis direction of the development roller 25. The end seal member 81 is also provided at an opposite end of the developing frame 31 in the longitudinal direction of the developing cartridge 4. Accordingly, the description of the opposite end of the developing frame 31 is omitted.

The developing cartridge 4 includes the sealing sheet 82 and the developing blade 35. The sealing sheet 82 and the regulating portion 35*a* of the developing blade 35 overlap the end seal member 81.

In the present exemplary embodiment, an opening formed by the sealing sheet 82, the regulating portion 35*a* of the developing blade 35, and the end seal member 81 is referred to as a development opening 90. As illustrated in FIG. 8B, the development roller 25 is mounted in the development opening 90, so that the development opening 90 is sealed with the development roller 25. In the development opening 90, the toner T is supplied to the development roller 25. When the development roller 25 rotates, the toner T carried on the development roller 25 is regulated by the regulating portion 35*a* and is then conveyed to the outside of the development opening 90 by the development roller 25.

In this case, a small amount of toner T may leak from the portion where the development roller 25 is exposed from the developing frame 31 at the downstream side of the developing blade 35. The developing cartridge 4 includes the collection member 137 serving as a storage member. If the toner T leaks, the collection member 137 collects (stores) the toner T.

A regulating portion end 35*al* of the developing blade 35 overlaps the end seal member 81. Accordingly, at the regulating portion end 35*al*, a contact pressure of the regulating portion 35*a* with respect to the development roller 25 increases. For this reason, the toner T is more likely to be melted and adhere to the regulating portion end 35*a*1. As a result, a gap can be formed between the regulating portion end 35*a*1 and the development roller 25.

When the developing cartridge 4 rotates, an aggregate of the toner T can be generated in a portion where the development roller 25 and the end seal member 81 are rubbed together. If this aggregate is sandwiched between the regulating portion end 35*a*1 and the development roller 25, a gap can be formed between the regulating portion end 35*a*1 and the development roller 25. Accordingly, the amount of leaked toner at both ends in the longitudinal direction of the developing blade 35 (the longitudinal direction is the same as the longitudinal direction of the developing cartridge 4 in the present exemplary embodiment) tends to be larger than that at a central portion thereof.

As illustrated in FIG. 9, the collection member 137 is mounted on the developing blade 35. The collection member 137 and the developing blade 35 form a collection portion 140, which serves as a storage portion that stores the toner T, and a first opening 140*d*, which communicates with the collection portion 140, between the collection member 137 and the developing blade 35. The first opening 140*d* is opposed to the development roller 25 in the portion where the development roller 25 is exposed to the outside of the developing frame 31. In a longitudinal direction of the collection member 137 (the longitudinal direction is the same as the longitudinal direction of the developing cartridge 4 in the present exemplary embodiment), the collection portion 140 is formed at each end of the collection member 137. As illustrated in FIG. 7, one end of the collection member 137 is coupled to the other end of the collection member 137.

As illustrated in FIG. 10A, a central collection portion 140*b* serving as a central storage portion is formed between the collection member 137 and the developing blade 35. The central collection portion 140*b* is located between the two collection portions 140 in the longitudinal direction of the collection member 137. More specifically, in the longitudinal direction of the collection member 137, the central collection portion 140*b* is located on an inner side of the collection member 137 relative to the two collection portions 140. In other words, the collection portions 140 are each disposed at one end side and the other end side of the central collection portion 140*b*. The central collection portion 140*b* and each of the collection portions 140 are partially partitioned by a wall portion 137*n*. In the direction orthogonal to the longitudinal direction of the collection member 137 (the direction is the same as the direction orthogonal to the rotational axis of the development roller 25 in the present exemplary embodiment), a sectional area of the collection portion 140 is larger than a sectional area of the central collection portion 140*b*.

A gap between the collection member 137 and the developing blade 35 is narrower in a portion where the wall portion 137*n* is disposed than in a portion where the central collection portion 140*b* and the collection portions 140 are formed. A movement of the toner T in the longitudinal direction of the collection member 137 can be regulated.

An inclined wall 137*f* that is inclined toward a central portion in the longitudinal direction is provided. In the longitudinal direction, in a case where the toner T moves from the central collection portion 140*b* toward each of the collection portions 140, the movement of the toner T is suppressed by the inclined wall 137*f*.

In the longitudinal direction of the developing cartridge 4, the configuration of the collection portion 140 and the peripheral portion thereof is similar to that at an opposite end of the collection member 137. Accordingly, the description of the opposite end of the collection member 137 is omitted.

The collection member 137 and the developing blade 35 will be described in more detail. As illustrated in FIG. 9, the support portion 35*b* of the developing blade 35 includes a first portion 35*b*1 and a second portion 35*b*2. The regulating portion 35*a* is mounted on the first portion 35*b*1. The first portion 35*b*1 is fixed to the developing frame 31. The support portion 35*b* is bent at a location between the first portion 35*b*1 and the second portion 35*b*2. In other words, a bent portion is formed between the first portion 35*b*1 and the second portion 35*b*2.

As illustrated in FIG. 9, the collection member 137 includes a first cover portion 137*b* and a second cover portion 137*j*. The first cover portion 137*b* and the second cover portion 137*j* are coupled with a connecting portion 137*a*.

The first cover portion 137*b* is opposed to each of the first portion 35*b*1 and the regulating portion 35*a*. In other words, the first cover portion 137*b* overlaps each of the first portion 35*b*1 and the regulating portion 35*a*, and covers each of the first portion 35*b*1 and the regulating portion 35*a*. In this configuration, a first storage area (first collection area) 140*a*1 is formed between the developing blade (regulating member) 35 and the first cover portion 137*b*. More specifically, the first storage area 140*a*1 is formed between the first portion 35*b*1 and the regulating portion 35*a*, and the first cover portion 137*b*.

The second cover portion 137*j* is opposed to the second portion 35*b*2. In other words, the second cover portion 137*j* overlaps the second portion 35*b*2 and covers the second portion 35*b*2. In this configuration, a second storage area (second collection area) 140*a*2 is formed between the regulating member 35 and the second cover portion 137*j*. More specifically, the second storage area 140*a*2 is formed between the second portion 35*b*2 and the second cover portion 137*j*.

As described above, the collection portion 140 includes the first storage area 140*a*1 and the second storage area 140*a*2. The first opening 140*d* communicates with the first storage area 140*a*1. More specifically, the first opening 140*d* allows the collection portion 140 to communicate with the outside of the collection portion 140. In other words, the first opening 140*d* allows the first storage area 140*a*1 to communicate with the outside of the first storage area 140*a*1.

A second opening 140*e* is formed between the developing blade (regulating member) 35 and the second cover portion 137*j*. More specifically, the second opening 140*e* is formed between the second portion 35*b*2 and the second cover portion 137*j*. In the direction orthogonal to the rotational axis direction of the development roller 25, the second opening 140*e* is located at the opposite side of the first opening 140*d*. In other words, in the direction orthogonal to the rotational axis direction of the development roller 25, the first opening 140*d* is disposed at one end of the collection portion 140, and the second opening 140*e* is disposed at the other end of the collection portion 140. The second opening 140*e* communicates with the second storage area 140*a*2. More specifically, the second opening 140*e* allows the collection portion 140 to communicate with the outside of the collection portion 140. In other words, the second opening 140*e* allows the second storage area 140*a*2 to communicate with the outside of the second storage area 140*a*2.

As illustrated in FIGS. 9 and 10A, the second cover portion 137*j* is provided with a recessed portion 137*k* that is opposed to the second storage area 140*a*2. As illustrated in FIG. 10B, the elastic seal member 139 serving as a sealing member (first sealing member) is mounted near the recessed portion 137*k*. The elastic seal member 139 is mounted on the collection member 137 through a double-faced adhesive tape. The elastic seal member 139 seals the second opening 140*e*. In this case, it can also be said that the second storage area 140*a*2 is a space formed by the developing blade 35, the collection member 137, and the elastic seal member 139.

The elastic seal member 139 has air permeability. The elastic seal member 139 includes a first seal portion 139*a* that extends in the longitudinal direction of the developing cartridge 4. In the longitudinal direction of the developing cartridge 4, a position of the first seal portion 139*a* overlaps a position of the collection portion 140. Second seal portions 139*b* that extend in a direction intersecting with the longitudinal direction of the developing cartridge 4 are each connected to one of ends of the first seal portion 139*a*. As illustrated in FIG. 11, a gap is formed between a leading end of each of the second seal portions 139*b* and the collection member 137.

As illustrated in FIG. 9, when the developing cartridge 4 is in a use state, the toner T leaked from the inside of the developing frame 31 is transmitted on the regulating portion 35*a* along a direction indicated by an arrow P. After that, the toner T falls in a direction indicated by an arrow Q due to its own weight and is then stored in the second storage area 140*a*2.

If the amount of toner T is large and thus the toner T cannot be stored in the second storage area 140*a*2, the toner T is stored in the first storage area 140*a*1.

In the present exemplary embodiment, in order to collect the toner T that falls from the surface of the development roller 25 and is scattered as much as possible, a leading end 137*c* of the first cover portion 137*b* that forms the first opening 140*d* is inclined downward in the rotating direction of the development roller 25. In this configuration, an area below the development roller 25 is widely covered with the first cover portion 137*b*.

In a sectional direction orthogonal to the rotational axis direction of the development roller 25, a width L5 of a connecting portion between the first storage area 140*a*1 and the second storage area 140*a*2 is smaller than the width of the first storage area 140*al* or the width of the second storage area 140*a*2. The second storage area 140*a*2 extends in a direction in which the second storage area 140*a*2 is inclined (orthogonal in the present exemplary embodiment) with respect to the first storage area 140*al*. In this configuration, the toner T collected in the second storage area 140*a*2 is prevented from flowing backward to the first storage area 140*a*1.

As illustrated in FIGS. 8B and 9, a hole 35*c* is formed in the support portion 35*b*. The hole 35*c* is covered with a sealing tape 141 from a side opposite to the side where the collection member 137 is mounted. As illustrated in FIG. 8B, the hole 35*c* is located on an inner side of the end seal member 81 in the longitudinal direction of the developing cartridge 4. More specifically, the hole 35*c* is disposed near an end of the developing blade 35 where the amount of leaked toner T tends to be large. As illustrated in FIG. 8B, the toner T passes through the hole 35*c* along a direction indicated by an arrow C.

The collection member 137 is disposed to cover the hole 35*c*. In the rotational axis direction of the development roller 25, a position of the hole 35*c* overlaps the position of the collection portion 140. As illustrated in FIG. 12, a width L3 of the hole 35*c* is smaller than a width L4 of the connecting portion between the first storage area 140*al* and the second storage area 140*a*2. In other words, the toner T passing through the hole 35*c* is more likely to fall in the second storage area 140*a*2.

Next, mounting of the collection member 137 on the developing blade 35 will be described with reference to FIG. 11. As illustrated in FIG. 11, a fixed surface 137*m* of the collection member 137 is attached to the regulating portion 35*a* of the developing blade 35 with a double-faced adhesive tape 38. The collection member 137 is mounted in a direction indicated by an arrow D in FIG. 11 in a state where the elastic seal member 139 is mounted. A gap L1 between the collection member 137 and the development roller 25 is desirably set to a small value so that the collection member 137 can collect a larger amount of toner T. On the other hand, the size of a gap L2 between the second portion 35*b*2 of the developing blade 35 and the second cover portion 137*j* of the collection member 137 varies due to component tolerance or an error caused during mounting. Accordingly, a thickness t1 of the elastic seal member 139 is set to be greater than the gap L2 in consideration of variation of the gap L2.

(Remanufacturing Method of Developing Cartridge)

Figure 1:
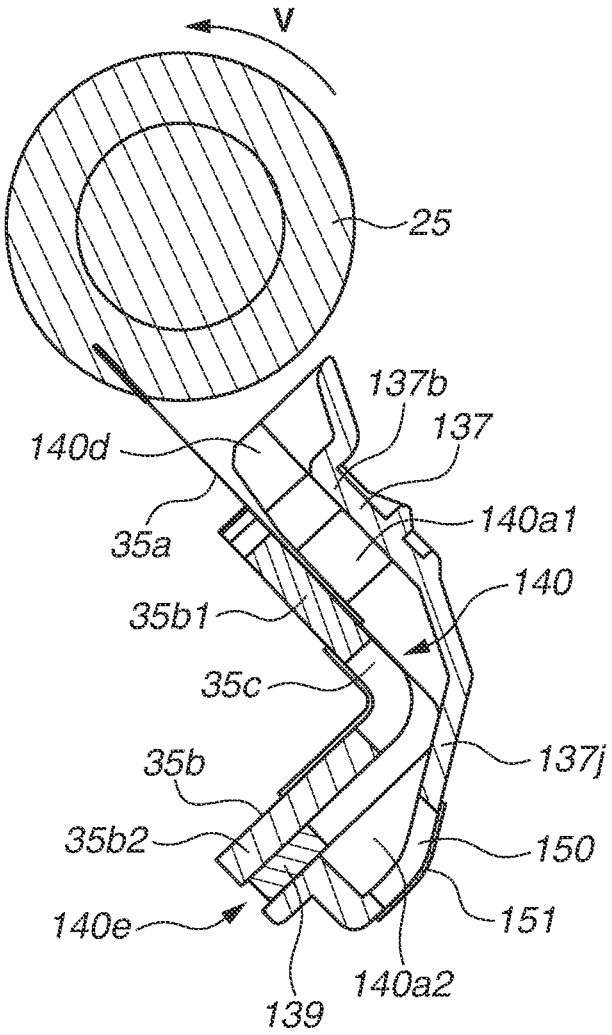
FIG. 1 is a sectional view illustrating a developing cartridge in the vicinity of a collection member according to an exemplary embodiment.
Figure 13:
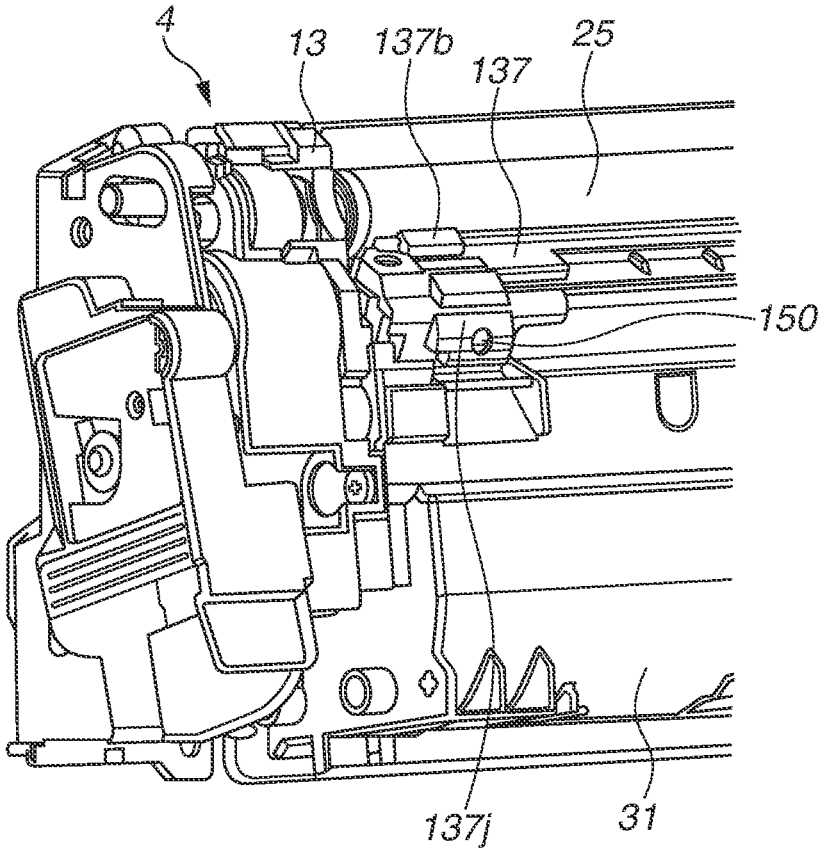
FIG. 13 is a perspective view illustrating the developing cartridge according to the exemplary embodiment.
Figure 14:
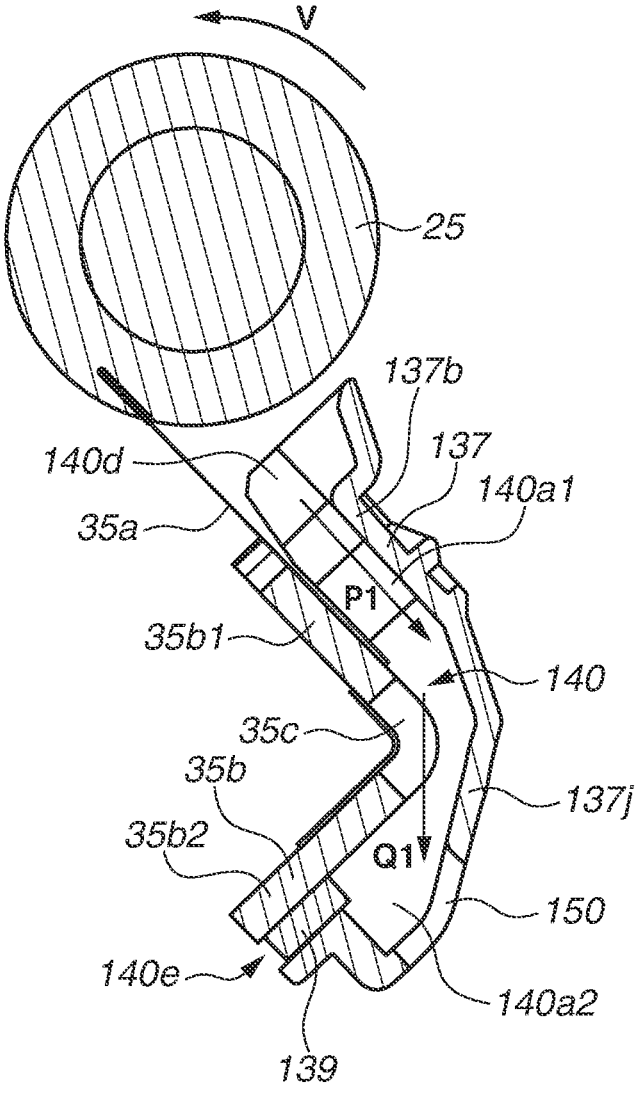
FIG. 14 is a sectional view illustrating the developing cartridge in the vicinity of the collection member according to the exemplary embodiment.

Next, a remanufacturing method of the developing cartridge 4 will be described with reference to FIGS. 1, 7, 13, and 14. FIG. 13 is a perspective view illustrating the developing cartridge 4. FIGS. 1 and 14 are sectional views each illustrating the developing cartridge 4 in the vicinity of the collection member 137. FIGS. 1 and 14 are illustrated based on an orientation in which the developing cartridge 4 is mounted on the apparatus main body 10. A vertical direction in FIGS. 1 and 14 is the same as the perpendicular direction (gravitational direction). FIGS. 1 and 14 are sectional views in the direction orthogonal to the rotational axis direction of the development roller 25, similar to FIG. 6.

The remanufacturing method of the developing cartridge 4 includes a preparation process for preparing a used developing cartridge 4. Further, the remanufacturing method of the developing cartridge 4 according to the present exemplary embodiment includes (1) a toner refilling process and (2) a toner removing process for removing the toner T from the collection member 137. These processes will be described below.

(1) Toner Refilling Process

The first development bearing 12 illustrated in FIG. 7 is fixed to the developing frame 31 with screws. Accordingly, the first development bearing 12 can be easily dismounted by using a tool such as a screwdriver. The developing frame 31 has a toner filling port that is closed with a toner cap (not illustrated). When the first development bearing 12 is dismounted, the toner filling port is exposed. By removing the toner cap, the toner T can be refilled from the toner filling port.

In the present exemplary embodiment, the first development bearing 12 is dismounted, and then the toner T is refilled from the toner filling port. Alternatively, a hole may be formed in the developing frame 31, and the toner T may be refilled through the hole. The hole used for refilling is closed after the toner T is refilled.

(2) Toner Removing Process

The toner T can be collected in the collection portion 140 of the collection member 137 of the developing cartridge 4. Accordingly, in the case of remanufacturing the developing cartridge 4, it is desirable that the toner T collected in the collection portion 140 be removed.

The remanufacturing method of the developing cartridge 4 includes a process for forming a suction hole 150 in the collection member 137 as a communicating hole that communicates with the collection portion 140, and a process for removing the toner T from the collection portion 140.

As illustrated in FIGS. 13 and 14, the suction hole 150 is formed in the collection member 137 (communicating hole forming process). The suction hole 150 is formed by, for example, removing part of the collection member 137. The suction hole 150 is formed between the first opening 140*d* and the second opening 140*e* in the direction orthogonal to the rotational axis direction of the development roller 25.

Next, the toner T is suctioned from the suction hole 150 to thereby remove the toner T from the collection portion 140 (a removing process or suctioning process). When the collection portion 140 is observed from the suction hole 150 and the amount of toner T is extremely small, the process for suctioning the toner T may be omitted.

As illustrated in FIG. 14, when the toner T is suctioned from the suction hole 150, air entering from the first opening 140*d* flows in a direction indicated by an arrow P1 and then flows in a direction indicated by an arrow Q1 inside the collection portion 140. Further, air flows toward the suction hole 150 from the second opening 140*e*. Thus, a flow of air can be formed in a wide range of the collection portion 140.

In the present exemplary embodiment, the second opening 140*e* is sealed with the elastic seal member 139. However, the elastic seal member 139 has air permeability, which allows the air to flow toward the suction hole 150 from the second opening 140*e*. The gap is formed between the leading end of each of the second seal portions 139*b* and the collection member 137, so that air flows toward the suction hole 150 from the second opening 140*e*. Accordingly, the toner T collected in the collection portion 140 can be effectively removed without removing the elastic seal member 139. However, it is also possible to remove the elastic seal member 139 to suction the toner T.

In the present exemplary embodiment, the suction hole 150 is formed in the second cover portion 137*j*, which covers the second storage area 140*a*2, and the suction hole 150 communicates with the second storage area 140*a*2. In this configuration, the regulating portion 35*a* can be prevented from being damaged in the process for forming the suction hole 150. Further, the suction hole 150 is formed at a position (on the back side of the collection portion 140) apart from the first opening 140*d* so that it possible to find the toner T and remove the toner T even when only a small amount of toner T is collected in the collection portion 140.

The remanufacturing method of the developing cartridge 4 described above can also be referred to as a cleaning method of the used developing cartridge 4. More specifically, the method can also be referred to as a manufacturing method for manufacturing a new developing cartridge 4 (second developing cartridge) in which the toner T can be refilled in the collection portion 140, by cleaning the used developing cartridge 4 (first developing cartridge).

To prevent the toner T from leaking from the suction hole 150 in a use state after the remanufacturing process, it is desirable that the suction hole 150 be sealed after the toner T collected in the collection portion 140 is suctioned. To close the suction hole 150, in the present exemplary embodiment, a process (communicating hole sealing process) is performed for attaching a seal 151 (second sealing member) from an outer appearance side of the collection member 137 as illustrated in FIG. 1.

To close the suction hole 150, the part of the collection member 137 that has been removed to form the suction hole 150 may be used as the second sealing member. In this case, it is desirable that the part of the collection member 137 be fitted into the suction hole 150 again and an adhesive material or the like be filled in a peripheral gap therebetween. It is also possible to use an adhesive material such as silicon bond to fill the suction hole 150.

The developing cartridge 4 can be remanufactured through the processes as described above. In the remanufactured developing cartridge 4, the toner T can be stored again in the collection portion 140.

The above-described processes can be carried out in a state where the collection member 137 is mounted on the developing blade 35. The above-described processes can also be carried out in a state where the developing blade 35 is mounted on the developing frame 31.

The remanufacturing method of the developing cartridge 4 described above can also be referred to as a manufacturing method for manufacturing a new developing cartridge 4 (corresponding to the second developing cartridge) from the used developing cartridge 4 (corresponding to the first developing cartridge). The used developing cartridge 4 can also be referred to as the developing cartridge 4 to be used as a material.

In addition to the toner filling process and the toner removing process described above, the remanufacturing method of the developing cartridge 4 may also include a process for, for example, replacing a consumable part (such as the development roller 25), and a process for cleaning the developing cartridge 4.

The order of the processes included in the remanufacturing method of the developing cartridge 4 can be appropriately selected as needed. For example, the toner refilling process may be carried out after the toner removing process for removing toner from the collection member 137. If any of the processes included in the remanufacturing method of the developing cartridge 4 is not to be executed, the processes can be omitted.

As described above, according to the exemplary embodiment of the present disclosure, it is possible to clean a component to which toner adheres without impairing the original function of the developing cartridge 4. More specifically, it is possible to provide a method for remanufacturing the developing cartridge 4 including the collection member 137 mounted on the developing blade 35.

According to the exemplary embodiment of the present disclosure, it is possible to provide the method for remanufacturing the developing device including the member that is mounted on the regulating member (developing blade) and includes the developer storage portion.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-033355, filed Feb. 26, 2019, which is hereby incorporated by reference herein in its entirety.

What is claimed is:

1. A remanufacturing method of a developing device, the developing device including, a frame configured to store developer, a developer carrying member configured to carry the developer, the developer carrying member being rotatably supported by the frame, a regulating member including a regulating portion configured to regulate the developer carried on the developer carrying member, and a support portion configured to support the regulating portion, the support portion being fixed to the frame, and a storage member configured to store the developer, the storage member being mounted on the regulating member, wherein a storage portion configured to store the developer and a first opening communicating with the storage portion are formed between the storage member and the regulating member, the first opening is opposed to an exposed portion of the developer carrying member, and the exposed portion is exposed to an outside of the frame, the remanufacturing method comprising:

forming a communicating hole communicating with the storage portion; and removing the developer from the storage portion.

2. The remanufacturing method of the developing device according to claim 1, wherein the support portion includes a first portion and a second portion, the regulating portion being mounted on the first portion, and a bent portion being formed between the first portion and the second portion, wherein the storage member includes a first cover portion and a second cover portion, the first cover portion overlapping each of the regulating portion and the first portion, the second cover portion overlapping the second portion, and wherein the storage portion includes a first storage area formed between the regulating member and the first cover portion, and a second storage area formed between the regulating member and the second cover portion, the first opening communicating with the first storage area.

3. The remanufacturing method of the developing device according to claim 2, wherein a second opening communicating with the second storage area is formed between the second cover portion and the regulating member, and wherein the communicating hole is formed between the first opening and the second opening in an orthogonal direction orthogonal to a rotational axis direction of the developer carrying member.

4. The remanufacturing method of the developing device according to claim 3, wherein the developing device includes a first sealing member configured to seal the second opening.

5. The remanufacturing method of the developing device according to claim 4, wherein the first sealing member has air permeability.

6. The remanufacturing method of the developing device according to claim 2, wherein the communicating hole is formed to communicate with the second storage area.

7. The remanufacturing method of the developing device according to claim 1, wherein a second opening communicating with the storage portion is formed between the storage member and the regulating member, wherein the second opening is located at an opposite side of the first opening in an orthogonal direction orthogonal to a rotational axis direction of the developer carrying member, and wherein the communicating hole is formed between the first opening and the second opening in the orthogonal direction.

8. The remanufacturing method of the developing device according to claim 7, wherein the developing device includes a first sealing member configured to seal the second opening.

9. The remanufacturing method of the developing device according to claim 8, wherein the first sealing member has air permeability.

10. The remanufacturing method of the developing device according to claim 1, wherein a central storage portion is formed between the regulating member and the storage member, and the central storage portion is located on an inner side of the storage member relative to the storage portion in a longitudinal direction of the storage member, wherein the storage member includes a wall portion configured to partition the storage portion from the central storage portion, and wherein a sectional area of the storage portion is larger than a sectional area of the central storage portion in a direction orthogonal to the longitudinal direction.

11. The remanufacturing method of the developing device according to claim 1, further comprising:

sealing the communicating hole with a communicating hole sealing member.

12. The remanufacturing method of the developing device according to claim 1, wherein the developing device is configured to be mountable on and removable from an apparatus main body of an image forming apparatus.

13. A developing device comprising:

a frame configured to store developer;

a developer carrying member configured to carry the developer, the developer carrying member being rotatably supported by the frame;

a regulating member including a regulating portion configured to regulate the developer carried on the developer carrying member, and a support portion configured to support the regulating portion, the support portion including a first portion and a second portion, the regulating portion being mounted on the first portion, and a bent portion being formed between the first portion and the second portion; and a storage member configured to store the developer, the storage member being mounted on the regulating member, the storage member including a first cover portion and a second cover portion, the first cover portion overlapping each of the regulating portion and the first portion, and the second cover portion overlapping the second portion, wherein a storage portion configured to store the developer, a first opening communicating with the storage portion, and a second opening communicating with the storage portion are formed between the storage member and the regulating member, the first opening is opposed to an exposed portion of the developer carrying member, and the exposed portion is exposed to an outside of the frame, wherein the storage portion includes a first storage area formed between the regulating member and the first cover portion, and a second storage area formed between the regulating member and the second cover portion, the first opening communicates with the first storage area, and the second opening communicates with the second storage area, and wherein the storage member is provided with a communicating hole communicating with the storage portion.

14. The developing device according to claim 13, wherein the communicating hole is formed between the first opening and the second opening in an orthogonal direction orthogonal to a rotational axis direction of the developer carrying member.

15. The developing device according to claim 13, further comprising:

a first sealing member configured to seal the second opening.

16. The developing device according to claim 15, wherein the first sealing member has air permeability.

17. The developing device according to claim 13, wherein the communicating hole is formed to communicate with the second storage area.

18. The developing device according to claim 13, wherein a central storage portion is formed between the regulating member and the storage member, and the central storage portion is located on an inner side of the storage member relative to the storage portion in a longitudinal direction of the storage member, wherein the storage member includes a wall portion configured to partition the storage portion from the central storage portion, and wherein a sectional area of the storage portion is larger than a sectional area of the central storage portion in a direction orthogonal to the longitudinal direction.

19. The developing device according to claim 13, further comprising:

a communicating hole sealing member configured to seal the communicating hole.

20. The developing device according to claim 13, wherein the developing device is configured to be mountable on and removable from an apparatus main body of an image forming apparatus.

* * * * *